US006802286B2

(12) United States Patent
Fujiwara et al.

(10) Patent No.: US 6,802,286 B2
(45) Date of Patent: Oct. 12, 2004

(54) VALVE TIMING CONTROL SYSTEM FOR AN INTERNAL COMBUSTION ENGINE

(75) Inventors: Morio Fujiwara, Tokyo (JP); Tatsuhiko Takahashi, Hyogo (JP); Koji Wada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/421,871

(22) Filed: Apr. 24, 2003

(65) Prior Publication Data

US 2003/0226533 A1 Dec. 11, 2003

(30) Foreign Application Priority Data

Apr. 25, 2002 (JP) ..... 2002-123349

(51) Int. Cl.[7] ..... F01L 1/34

(52) U.S. Cl. ..... 123/90.15; 123/90.17; 123/90.31

(58) Field of Search ..... 123/90.15, 90.17, 123/90.31

(56) References Cited

U.S. PATENT DOCUMENTS 6,109,225 A * 8/2000 Ogita et al. ..... 123/90.15

FOREIGN PATENT DOCUMENTS

JP 7-091280 A 4/1995
JP 10-227235 A 8/1998

* cited by examiner

*Primary Examiner*—Thomas Denion
*Assistant Examiner*—Zelalem Eshete
(74) *Attorney, Agent, or Firm*—Sughrue Mion, PLLC

(57) ABSTRACT

The valve timing control system of the present invention comprises an actuator for changing an actual valve timing of an intake valve or an exhaust valve; an oil pressure adjusting unit for supplying operating oil to the actuator, and adjusting the oil pressure thereof; an actual valve timing control unit for controlling the actuator by controlling the oil pressure adjusting unit, so that the actual valve timing follows up a target value; and an oil temperature estimation unit for estimating the temperature of the operating oil, according to an operating state of the internal combustion engine from a previous operation, and according to its current operating state. Based on the estimated oil temperature, the actual valve timing control unit switches a control amount for controlling the oil pressure adjusting unit.

12 Claims, 13 Drawing Sheets

DIAGRAM EXPLAINING OPERATION FOR DETERMINING WARM RESTART

VALVE TIMING CONTROL SYSTEM FOR AN INTERNAL COMBUSTION ENGINE

BACKGROUND OF THE INVENTION

1. Field of the Invention

The present invention relates to a valve timing control system for an internal combustion engine, and more particularly to a valve timing control system for an internal combustion engine which adjusts opening and closing timing (valve timing) of an intake valve and/or an exhaust valve according to operating state of the internal combustion engine.

2. Description of the Related Art

The conventional techniques in this field include ones disclosed in, for example, Japanese Patent Application Laid-open no. Hei 7-91280 and Japanese Patent Application Laid-open no. Hei 10-227235. These publications indicate techniques for obtaining desired valve timings by means of valve timing control mechanisms, which use oil pressure-type actuators. Also disclosed are examples in which, in these valve timing control mechanisms, measures are taken to resolve a control deviation in valve timing control caused by a difference in a viscosity state of oil at each oil temperature.

In accordance with the above-mentioned conventional techniques, in order to perform a correction of a control amount, in the former technique, there is arranged an oil temperature sensor for detecting an oil temperature, which causes a cost increase. Further, in the latter technique, the temperature of cooling water at the starting time, and an operating state of the internal combustion engine (for example, a heat generation amount), are used to estimate the oil temperature. However, after the internal combustion engine has been stopped, the water temperature drops faster than the oil temperature, and when the engine is restarted after being left off for a certain amount of time, the difference between the water temperature and the oil temperature is great, and thus oil temperature cannot be estimated precisely. In a case where the cooling water temperature is substituted for the oil temperature immediately after starting the engine, an appropriate control amount cannot be given, and thus there was a problem that a difference between a target valve timing and an actual valve timing was great.

Further, there also is a conventional device, which has a lock mechanism and performs a lock pin release operation, where the oil temperature is estimated from the water temperature and then the control amount is determined. However, as described above, since the precision of the oil temperature estimation immediately after starting the engine is poor, there is set a control amount that includes an extra amount so that the lock pin is removed without fail. In this device, unnecessary pin-pulling operations are performed even after the lock pin release. Thus, a delay occurred in following up the actual target timing normally required for the operating state, and there was a problem that this deteriorated drivability of the internal combustion engine.

SUMMARY OF THE INVENTION

The present invention has been made to solve the above-mentioned problems, and therefore has an object thereof to obtain a valve timing control system for an internal combustion engine in which precision in estimating an oil temperature at a starting time is improved and a control deviation is reduced by giving an appropriate control amount.

A valve timing control system for an internal combustion engine according to the present invention, comprises: operating state detecting means for detecting an operating state of an internal combustion engine; actual valve timing detection means for detecting valve timing of at least one of an intake valve and an exhaust valve; target valve timing setting means for setting a target valve timing for the valve timing, based on a detection result from the operating state detecting means; an actuator for changing the valve timing of at least one of the intake valve and the exhaust valve; oil pressure adjusting means for supplying oil to the actuator to drive the actuator and performing adjustment of the oil pressure thereof; actual valve timing control means for controlling the actuator by controlling the oil pressure adjusting means, in order to make the valve timing follow up the target valve timing; and oil temperature estimation means for estimating the temperature of the oil supplied to the actuator by the oil pressure adjusting means, based on a state of the internal combustion engine during its previous operation time, and based on its current operation state, wherein the actual valve timing control means switches a control amount for controlling the oil pressure adjusting means, based on the oil temperature estimated by the oil temperature estimation means.

Therefore, the actual valve timing can be accurately controlled with respect to the target valve timing, to thereby obtain an effect that deterioration of the drivability, fuel efficiency, and exhaust can be prevented.

DETAILED DESCRIPTION OF THE PREFERRED EMBODIMENTS

Embodiment 1

Figure 1:
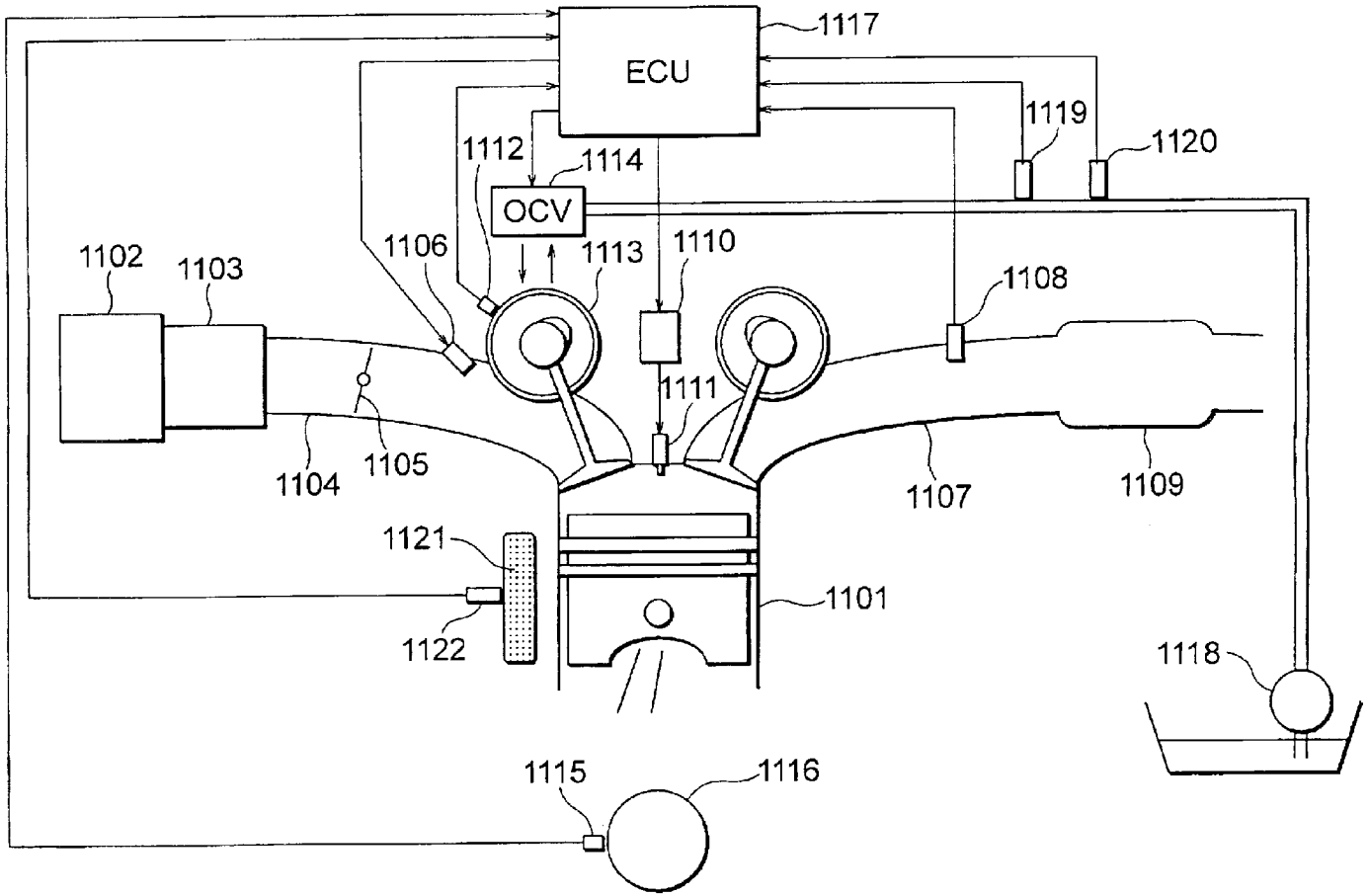
FIG. 1 shows a structure of a valve timing control system for an internal combustion engine and a periphery thereof, according to a conventional art and the present invention.

Hereinafter, an embodiment of the present invention will be described with reference to the drawings. In Embodiment 1, occurrence of an error in an estimation of oil temperature at an engine start time is prevented by oil temperature estimation means, which performs an estimation of the oil temperature by using a cooling water temperature, and an operating state (for example, a heat generation amount) at a start time, as in the conventional technique. Generally, the water temperature falls faster than the oil temperature after the internal combustion engine is stopped, and thus a great difference occurs between the water temperature and the oil temperature after the engine is left off for a certain amount of time. With the oil temperature estimation means in the conventional art, at the start time or immediately after the start time, the value of the cooling water temperature which is lower than the actual oil temperature is substituted for as the estimated oil temperature. Further, the heat generation amount at this point is 0 at the start time. Even immediately after the start time, there is insufficient heat to supplement the temperature difference between the cooling water temperature and the actual oil temperature. Since the estimated oil temperature having the lower value than the actual oil temperature is used to obtain the control amount, an appropriate control amount for the actual oil temperature can not be provided. This causes problems such that the difference between the target valve timing and the actual valve timing becomes great, hunting occurs, and the like.

However, in accordance with the present embodiment, based on a condition of whether or not a warming up state continued for a given duration of time when the engine was driven a previous time, and also based on the water temperature when the engine was started the present time, it is estimated whether the oil temperature is in a warming up state or in a cooling down state, to reduce an error in estimating of the oil temperature at the start time. When in the state where the oil is judged as being in the warming up state as described above, if the engine is stopped once, and then left off for a certain amount of time, the way that the temperatures drop during the stopped state is such that the water temperature drops faster than the oil temperature. Therefore, the oil temperature at the time when the engine is restarted is higher than the temperature of the cooling water temperature. In order to solve this problem, a water temperature, which can guarantee that the oil temperature is in the warming up state, is experimentally determined in advance, and this water temperature value is set as a predetermined value. Accordingly, by judging whether the water temperature at the start time is greater or less than the predetermined value, it can be estimated whether or not the oil temperature is in the warming up state, and switching to the control amount that is appropriate for the oil temperature can be performed at the start time, to thereby solve the problems of the great difference between the target valve timing and the actual valve timing, and the occurrences of hunting, and the like, thereby enabling the valve timing to be controlled appropriately.

Figure 14:
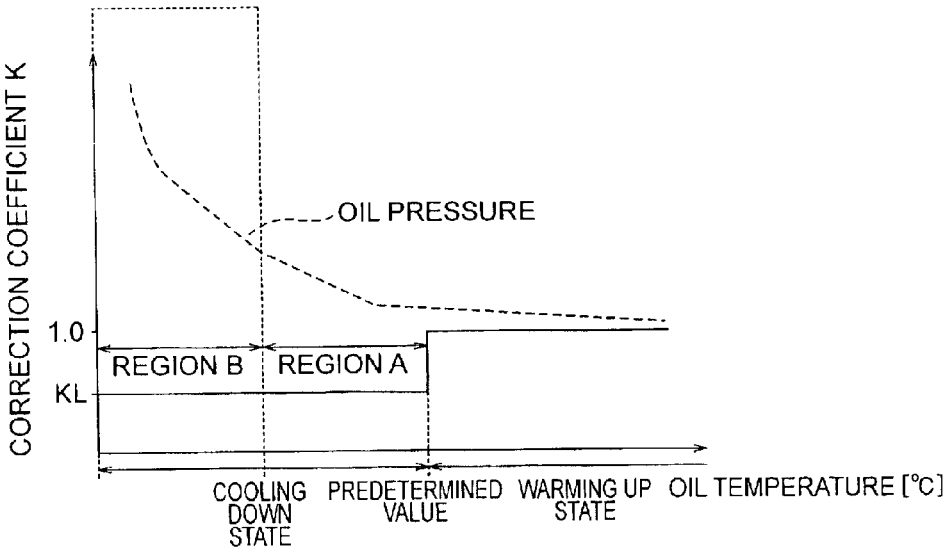
FIG. 14 is an explanatory diagram illustrating a setting value of an oil temperature correction coefficient in valve timing control, with respect to the oil temperature in the internal combustion engine.

FIG. 14 illustrates a correction coefficient K for correcting the control amount in accordance with the warming up state and the cooling down state of the oil temperature. Further, a characteristic of the oil pressure with respect to the oil temperature at given engine r.p.m. is indicated in the diagram by a dotted line. In the oil temperature/oil pressure characteristic, change in the oil pressure within the region where the oil temperature is above a certain value (i.e., during the warming up state) is smaller than the change in the region where the oil temperature is below the given value (i.e., the cooling down state), and becomes nearly flat. Therefore, even with correction coefficient K setting (K=1.0) for the warming up state shown in FIG. 14, the controllability of the valve timing hardly deteriorate. However, the oil pressures in the warming up state and in the cooling down state differ greatly from each other, and when the same control amount is used, in the cooling down state where the oil pressure is greater, the actuator is moved more and hunting becomes easier to occur. Therefore, the cooling down state correction coefficient K (K=KL) is set so as to reduce the control amount, in order to inhibit the actuator from moving excessively.

Further, as shown in FIG. 14, the lower the oil temperature is, the higher the oil pressure tends to become. Accordingly, it is necessary to set the control amount gradually smaller. Here, as the cooling of the internal combustion engine proceeds (for example, when the water temperature becomes lower than a certain temperature), misfire occurs in the internal combustion engine. Therefore, there is a region (region B shown in FIG. 14) during which the operation of the valve timing is stopped. During the cooling down range (i.e., region A shown in FIG. 14) of the valve timing operation range, excluding the above-mentioned valve timing operation stopping region (region B), the change in the oil pressure is not great enough to influence the controllability. Therefore, during the cooling down state, the valve timing is controlled without altering the correction coefficient KL. In accordance with the present embodiment, during the above-mentioned valve timing operation region, the valve timing mechanism is satisfactorily controlled by switching the binary correction coefficient K (1.0 and KL).

FIG. 1 is a construction diagram of an internal combustion engine having the valve timing control system for an internal combustion engine according to Embodiment 1 of the present invention. In the diagram, reference numeral 1101 denotes an internal combustion engine; reference numeral 1102 denotes an air cleaner for cleaning air sucked into the internal combustion engine 1101; reference numeral 1103 denotes an airflow sensor for measuring an air amount sucked into the internal combustion engine 1101; reference numeral 1104 denotes an air intake pipe for sucking in the air; reference numeral 1105 denotes a throttle valve for adjusting the air amount sucked in, and controlling an output of the internal combustion engine 1101; reference numeral 1106 denotes an injector for supplying fuel in proportion to the amount of air that is sucked in; reference numeral 1111 denotes a spark plug for generating sparks to burn an air-fuel mixture inside a combustion chamber; reference numeral 1110 denotes a spark coil for supplying a high voltage energy to the spark plug 1111; reference numeral 1107 is an exhaust pipe for expelling combusted exhaust gas; reference numeral 1108 denotes an O2 sensor for detecting an amount of remaining oxygen in the exhaust gas; and reference numeral 1109 denotes a ternary catalyzer capable of simultaneously cleaning hazardous gasses THC, CO and NOx in the exhaust gas. Reference numeral 1116 is a sensor plate for crank-angle detection, which is provided with an extrusion (not shown in the diagram) at a given position, and is mounted to the crank shaft and rotates integrally with the crank shaft. Reference numeral 1115 denotes a crank angle sensor for detecting the position of the crank shaft, being configured so as to emit a signal when the extrusion (not shown in the diagram) of the sensor plate 1116 crosses the crank angle sensor, thus detecting the crank angle. Reference numeral 1113 denotes an actuator (i.e., a valve timing adjustment device) for changing the relative angle of the cam shaft with respect to the crank shaft. Reference numeral 1112 denotes a cam angle sensor for generating a pulse signal due to an extrusion of a cam angle detection sensor plate, which is not shown in the diagram as in the crank angle sensor, thus detecting the cam angle. Reference numeral 1114 denotes an oil control valve (hereinafter, referred to as the "OCV") (i.e., oil pressure adjusting means), which adjusts the oil pressure supplied to the cam phase actuator (i.e., the valve timing adjustment device) 1113, to control the relative angle (i.e., the cam phase) of the cam shaft with respect to the crank shaft. Reference numeral 1117 denotes an ECU 2, which performs control of the cam phase, and also performs control of the internal combustion engine 1101. Reference numeral 1118 denotes an oil pump, which generates the oil pressure to drive the cam phase actuator 1113, and also pumps a lubricating oil for the respective constitutive parts of the internal combustion engine 1101. Reference numeral 1121 denotes cooling water, which cools the internal combustion engine 1110. Reference numeral 1122 denotes a water temperature sensor, which detects the temperature of the cooling water 1121. Note that, for supplementary purposes, FIG. 1 shows an oil pressure sensor 1119 for detecting the oil pressure and an oil temperature sensor 1120 for detecting the oil temperature. As described above, these were provided in the conventional devices described in Japanese Patent Application Laid-open no. Hei 7-91280, etc. However, since they cause a cost increase, they are not actually provided in the present invention.

The ECU 1117 calculates a target valve timing VTT based on the operating state of the internal combustion engine 1101. Further, it calculates an actual valve timing VTA based on the crank angle detected by the crank angle sensor 1115 and the cam angle detected by the cam angle sensor 1112. By performing feedback based on a difference ER between the actual valve timing VTA and the target valve timing VTT to control an electrical current value supplied to the OCV 1114 or to control a duty ratio, the actual valve timing VTA can be made to correspond to the target valve timing VTT. The OCV 1114 selects an oil passage for supply oil to the cam phase actuator 1113, and adjusts the applied oil pressure, to control the valve timing.

Figure 2:
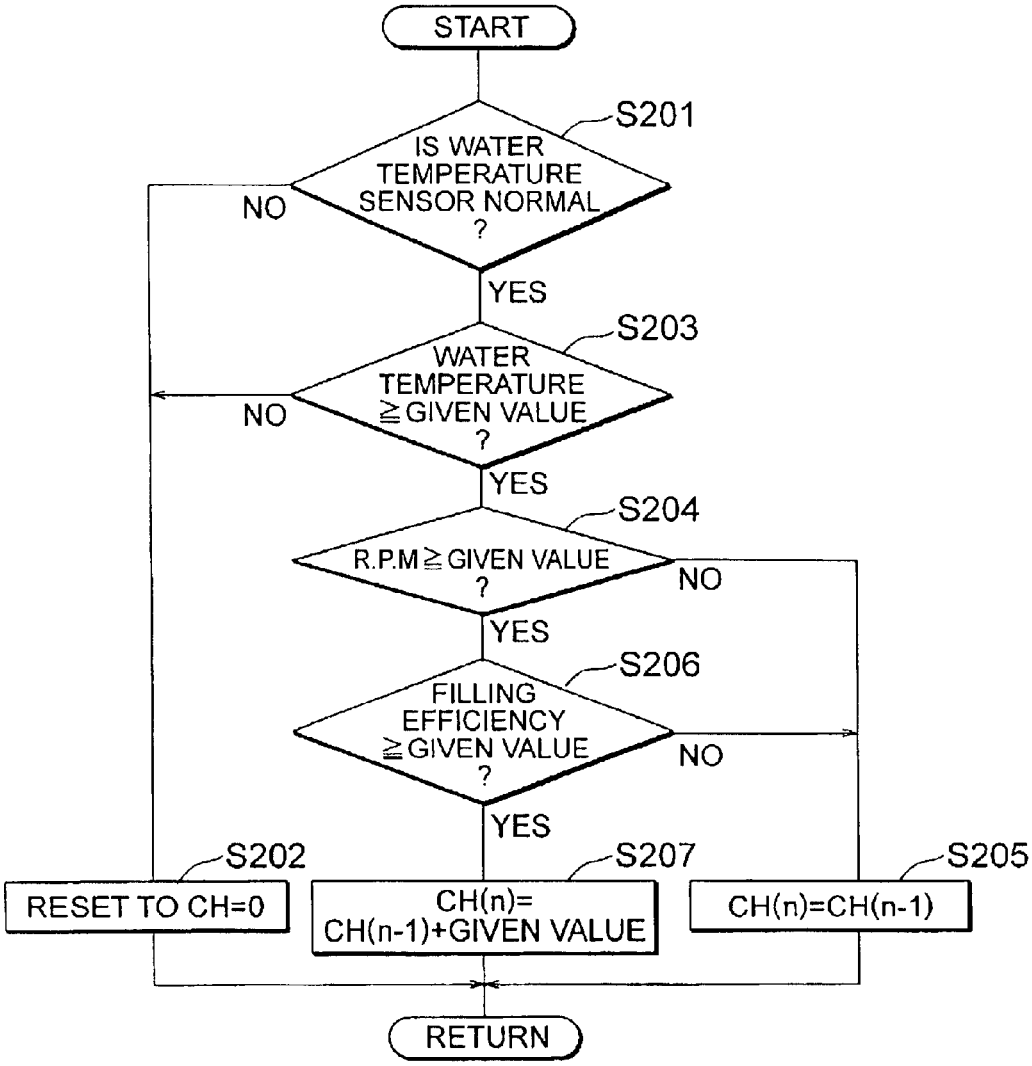
FIG. 2 is a flow chart for explaining an operation of a valve timing control system for an internal combustion engine according to Embodiment 1 of the present invention.
Figure 3:
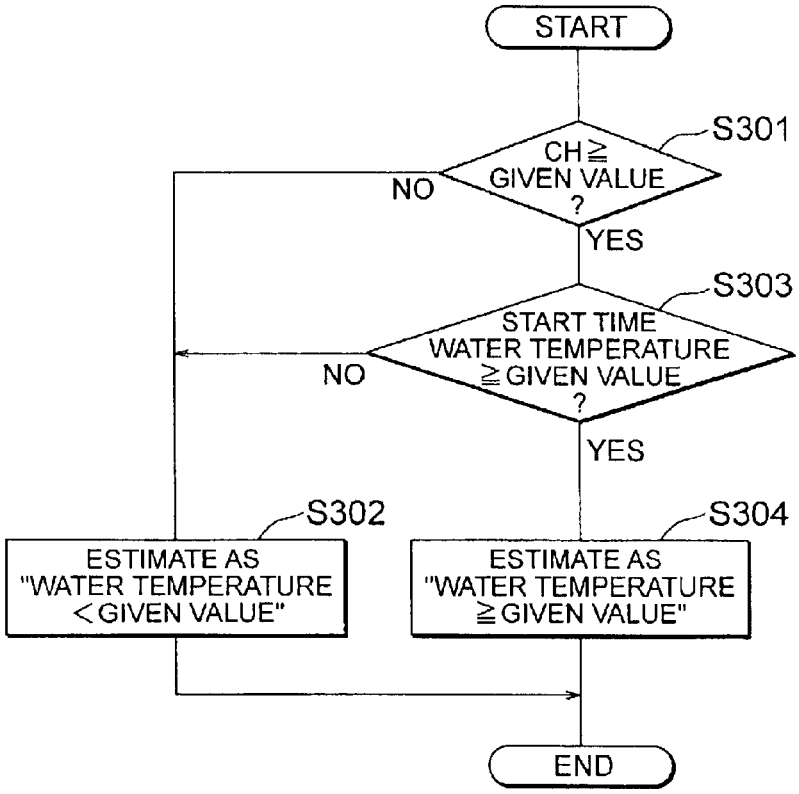
FIG. 3 is a flow chart for explaining an operation of the valve timing control system for an internal combustion engine according to Embodiment 1 of the present invention.

Next, a processing sequence of the oil temperature estimation by the ECU 1117 used in the valve timing control system for an internal combustion engine according to Embodiment 1 of the present invention (which corresponds to the oil temperature estimation means), will be described based on flow charts shown in FIG. 2 and FIG. 3. Note that, the oil temperature estimation processing is executed repeatedly in the ECU 1117 at given time intervals. FIG. 2 illustrates a flow of processing in which 3 parameters (the cooling water temperature, the engine rotation speed (i.e., the engine r.p.m.), and filling efficiency (i.e., the intake air amount)) are used to estimate whether or not the internal combustion engine is in the warming up state, and in which, in the case where it is estimated that the internal combustion engine is in the warming up state, the duration thereof is accumulated (that is, a warming-up completion counter is counted up). FIG. 3 illustrates the flow of processing in which the warming-up completion counter value from FIG. 2 (from the previous operation time), and the current water temperature at the start time, are used to determine whether or not the oil temperature is above the predetermined value.

First, an explanation will be made regarding FIG. 2. In FIG. 2, first, at step S201, it is determined whether or not the water temperature sensor 1122 is normal. At step S201, in a case where the water temperature sensor 1122 is normal (if Yes), then, at step S203, it is determined whether or not the water temperature is above a predetermined value (e.g., 90[° C.]). On the other hand, in a case where sensor abnormality was determined at step S201 (if No), the process moves to step S202, where the warming-up completion counter CH is reset to 0 and the present processing ends. At step S203, in a case where the water temperature is above a predetermined value (if Yes), then, at step S204, it is determined whether or not the engine rotation speed (the engine r.p.m.) is above the predetermined value (e.g., 400 [r/m]). On the other hand, at step S203, in a case where it is below the predetermined value (if No), the warming-up completion counter is reset to 0, and the present processing ends.

At step S204, in a case where it is above the predetermine value (if Yes), at step S206 it is determined whether or not the filling efficiency (the intake air amount) is above a predetermined value (e.g., 0.3). In a case where it is above the predetermined value (if Yes), then, at step S207, the value of the warming-up completion counter CH is increased by an amount equal to a predetermined processing cycle (e.g., 100 [msec]) of the warming-up determination counter processing, and then the present processing ends.

At step S204, in a case where it is below the predetermine value (if No), at step S205, the value of the warming-up completion counter CH is kept as it is and then the present processing ends.

At step S206, in a case where the filling efficiency is below the predetermine value (if No), the process moves to step S205, and the value of the warming-up completion counter CH is kept as it is and then the present processing ends.

The value of the warming-up completion counter CH is stored in the ECU 1117 even after the engine is stopped (i.e., even after the ignition switch is turned OFF).

Next, the process moves to processing shown in FIG. 3, and the warming-up completion counter CH value obtained at FIG. 2 is used as a value indicating the duration that the warming up state continued during the previous operation time. In FIG. 3, at step S301, it is determined whether or not the warming-up completion counter CH is greater than a given duration Th (e.g., 60 [sec]). In a case where, at step S301, the counter CH was greater than the given duration Th (if Yes), the process moves to step S303, and it is determined whether or not the start time water temperature is greater than a given value (e.g., 86[° C.]). At step S303, in a case where the start time water temperature was greater than the given value (i.e., Yes), the process moves to step S304, and it is estimated that the oil temperature is greater than the given value (i.e., the warming up state (a warm restart)), and the current processing ends.

On the other hand, at step 301, in a case where it is below the predetermined value (if No), the process moves to step S302, and it is estimated that the oil temperature is smaller than the given value and then the present processing ends.

At step S303, in a case where the start time water temperature in the current operation is below the given value (if No), the process moves to step S302, and it is estimated that the oil temperature is smaller than the given value (i.e., the cooling up state (a cool restart)) and then the present processing ends.

As described above, in accordance with the present embodiment, in the case where the internal combustion engine continued the warming up state for the given duration of time during the previous operation time, and the start time water temperature in the current operation is above the given value, the oil temperature estimation means estimates that the oil temperature is above the given value (i.e., the warm restart).

Figure 4:
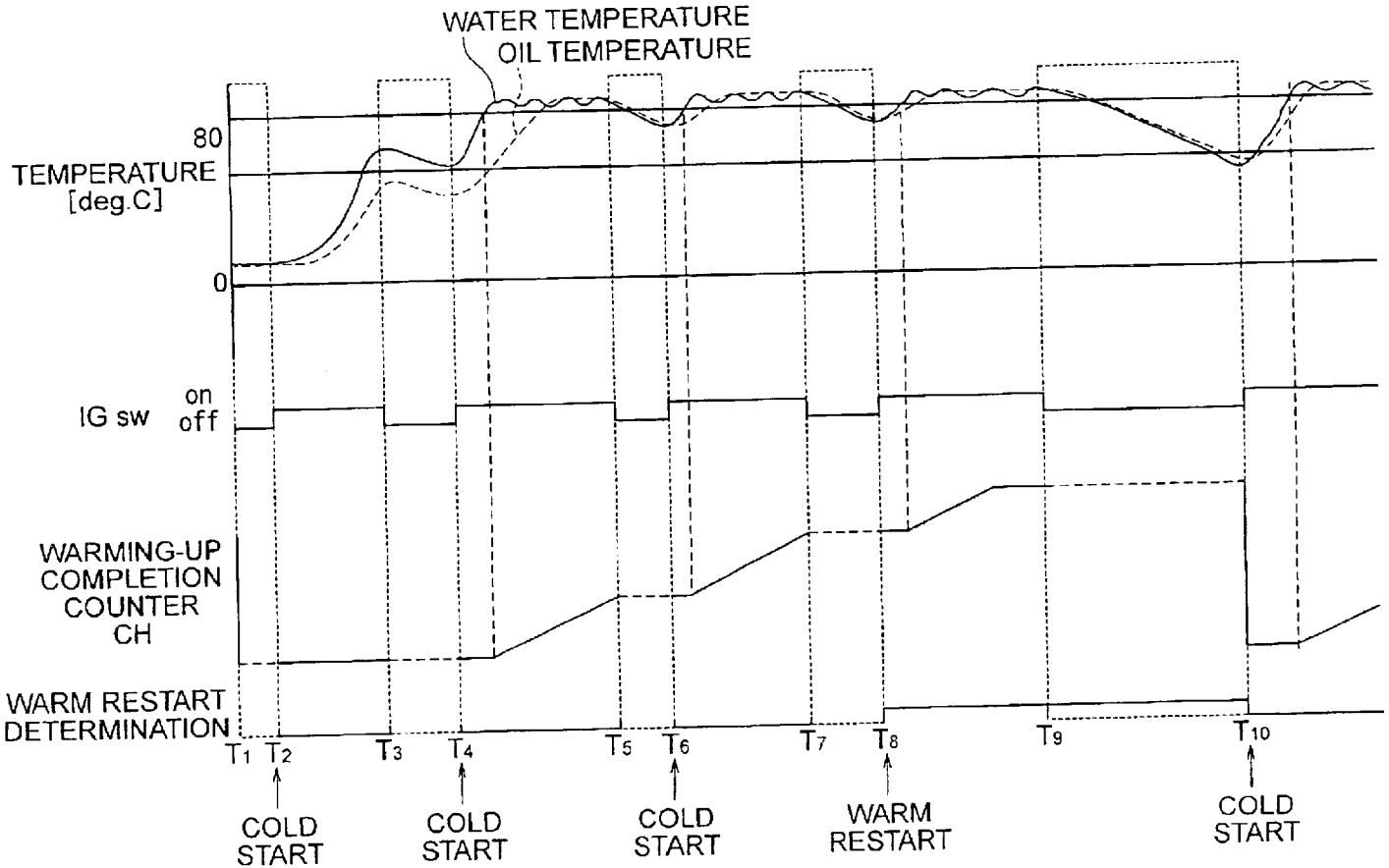
FIG. 4 is a timing chart for explaining an operation of the valve timing control system for an internal combustion engine according to Embodiment 1 of the present invention.

FIG. 4 is a time chart of the warm restart determination operation. Points in time T1, T3, T5, T7 and T9 each denote timing where the engine is stopped. Points in time T2, T4, T6, T8 and T10 each denote timing where the engine is started. Further, T8 is the above-mentioned warm restart timing, and the other points each indicate cold start timing.

During the operation from point T4 to T5, the warming-up completion counter CH starts counting upward from the point where the water temperature becomes greater than a given value (e.g., 90[° C.]).

At point T5, even when the ignition switch is turned OFF (IGswOFF), the warming-up completion counter CH value is stored, and, during the operation from point T6 to T7, if the water temperature is less than a given value, the warming-up completion counter CH maintains its same value without its count rising. Then, when the water temperature has exceeded a given duration of time, the warming-up completion counter CH starts counting up again.

At the start time at point T8, the warming-up completion counter CH has exceeded a given duration (e.g., 600 [sec]), and, since the start time water temperature is greater than a given value (e.g., 86[° C.]), it is judged that the oil temperature is above the given value (i.e., the "warm restart"). At the start time at point T10, the warming-up completion counter has exceeded the given duration (e.g., 600 [sec]), but since the start time water temperature is less than the given value, it is judged that the water temperature is less than the given value (i.e., the "cold restart"). When this occurs, the warming-up completion counter is reset to 0.

Next, the actual valve timing control that is used in the valve timing control system for an internal combustion engine according to the present embodiment (which corresponds to actual valve timing control means) will be described based on a flow chart shown in FIG. 5.

Figure 5:
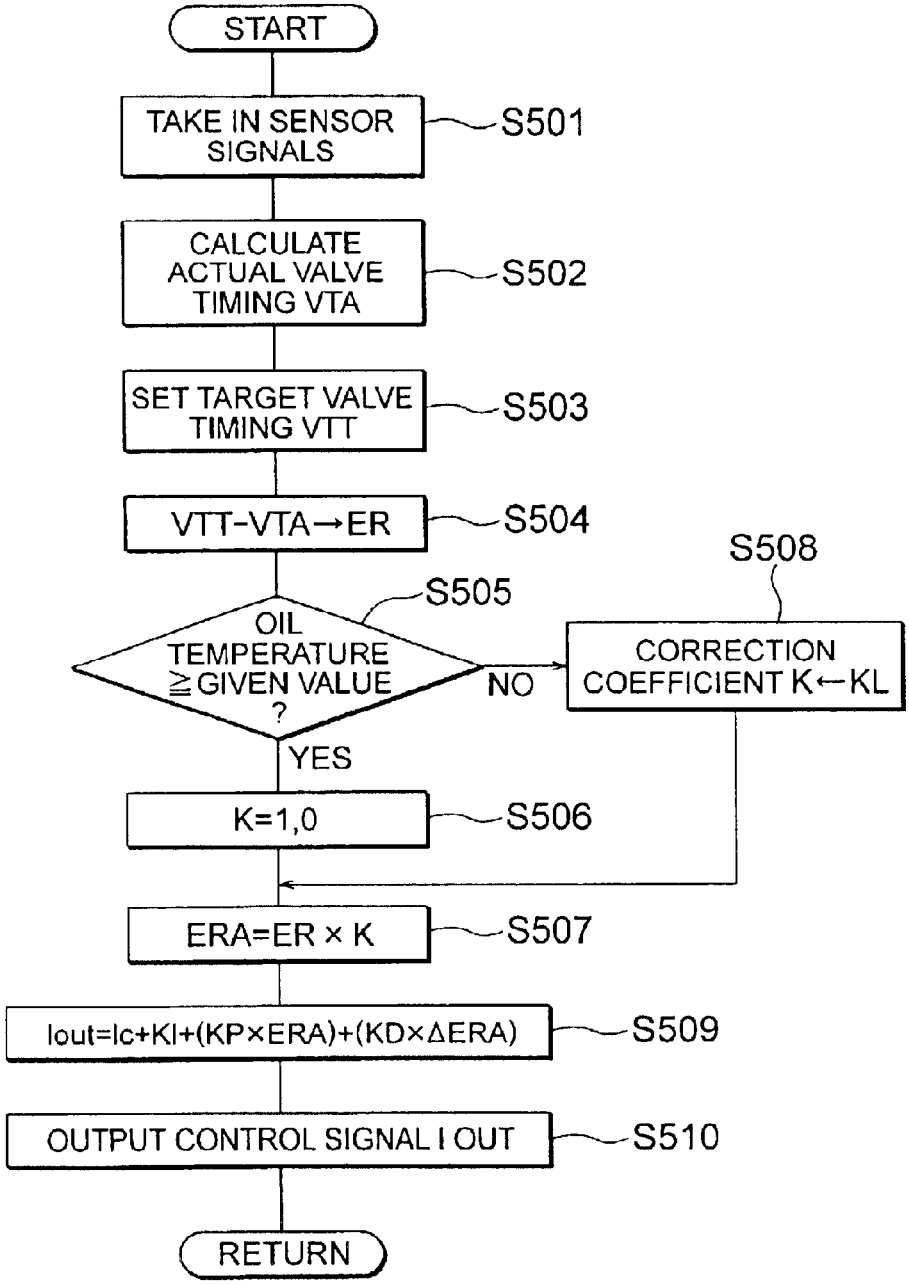
FIG. 5 is a flow chart illustrating content of control performed by actual valve timing control means of the valve timing control system for an internal combustion engine according to Embodiment 1 of the present invention.

In FIG. 5, at step S501, from the crank angle sensor, the cam angle sensor, the air intake amount sensor, the throttle sensor and the water temperature sensor (i.e., the operating state detection means) are inputted engine operating state signals indicative of the engine r.p.m., the valve timing, the air intake amount, the throttle aperture angle, and the cooling water temperature, respectively. Then, at step S502, the crank angle signal and the cam angle signal are used to calculate the displacement angle (i.e., the actual valve timing) VTA of the cam shaft with respect to the crank shaft (this corresponds to the actual valve timing detection means). At step S503, a target valve timing VTT corresponding to the operating state is set according to a map in which target value timings VTT are determined in correspondence with operating states in advance (i.e., target valve timing setting means). At step S504, the difference ER between the target valve timing VTT and the actual valve timing VTA is obtained, and at step S505 it is judged whether the oil temperature estimated by the above-mentioned oil temperature estimation processing is above a given value (e.g., 90[° C.]). Then, if it is above the given value, at step S506, the correction coefficient K=1.0 is substituted for, and, at step S507, the difference ER is multiplied by the correction coefficient K, to thereby obtain a post-oil-temperature-correction deviation ERA.

At step S505, if the oil temperature is less than the given value, then at step S508, the graph shown in FIG. 14 is used to establish "correction coefficient K=low oil temperature correction coefficient KL". Then the process advances to step S507 where the post-oil-temperature-correction deviation ERA is obtained.

At step S509, an OCV current value Iout is set to $Iout=Ic+KI+(KP\times ERA)+(KD\times \Delta ERA)$. Here, Ic represents a holding current value; KP represents gain corresponding to proportional control action; KD represents gain corresponding to derivative control action; and KI represents an integral increase/decrease value which is calculated based on a post-oil temperature correction deviation ERA. ΔERA represents a variation amount per ERA unit time, where $\Delta ERA=(ERA(n)-ERA(n-1))/(T(n)-T(n-1))$.

At step S510, the OCV current value Iout (i.e., a control signal) is outputted, and the present processing ends.

As described above, in accordance with the present invention, the control amount determined by the actual valve timing control means is switched based on the oil temperature of the operating oil in the valve timing control mechanism, which is estimated by the oil temperature estimation means in accordance with the operating state of the internal combustion engine from the previous time, and in accordance with its current operating state. Accordingly, the oil temperature of the operating oil in the valve timing control mechanism can be estimated with good precision based on the operating state of the internal combustion engine from the previous time and based on the current operating state, without additionally providing an oil pressure sensor or the like. Therefore, the actual valve timing can be accurately controlled with respect to the target valve timing, to thereby obtain an effect that deterioration of the drivability, fuel efficiency, and exhaust can be prevented.

Embodiment 2

Since the construction of the internal combustion engine according to the present embodiment is similar to that of the above-mentioned Embodiment 1 (FIG. 1), description thereof is omitted here.

Figure 6:
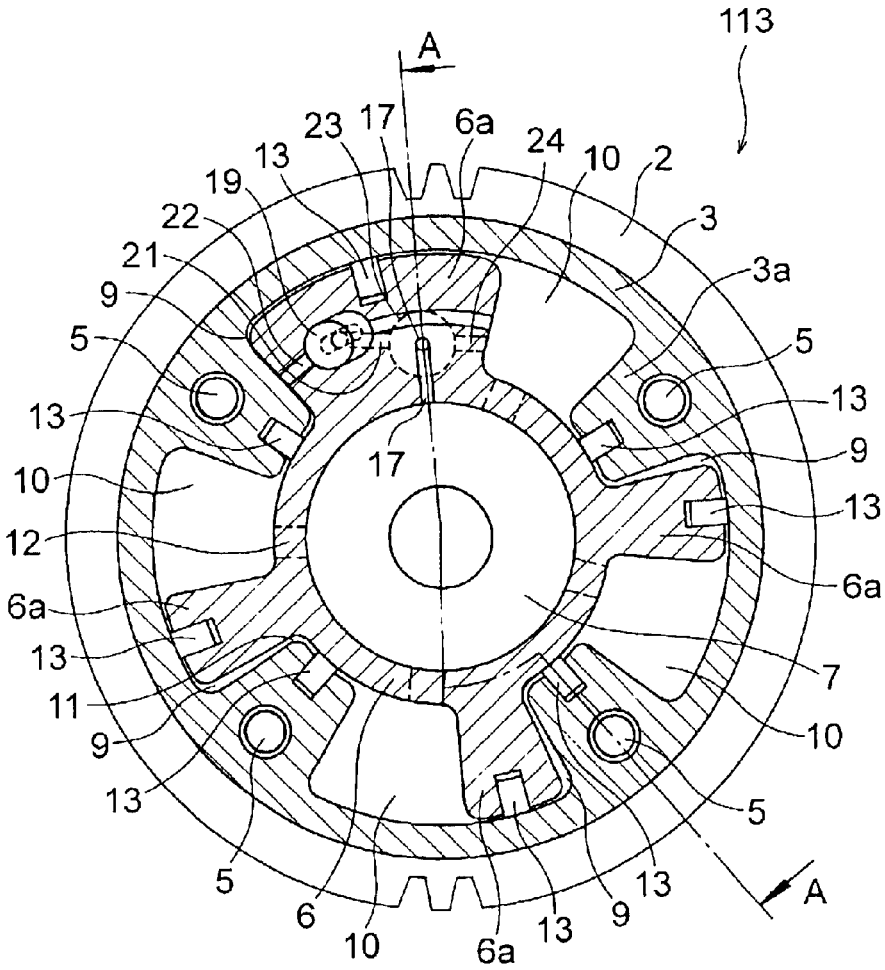
FIG. 6 is a lateral cross-sectional diagram showing an internal construction of an actuator (valve timing control system) of a valve timing control system according to Embodiment 2 of the present invention.
Figure 7:
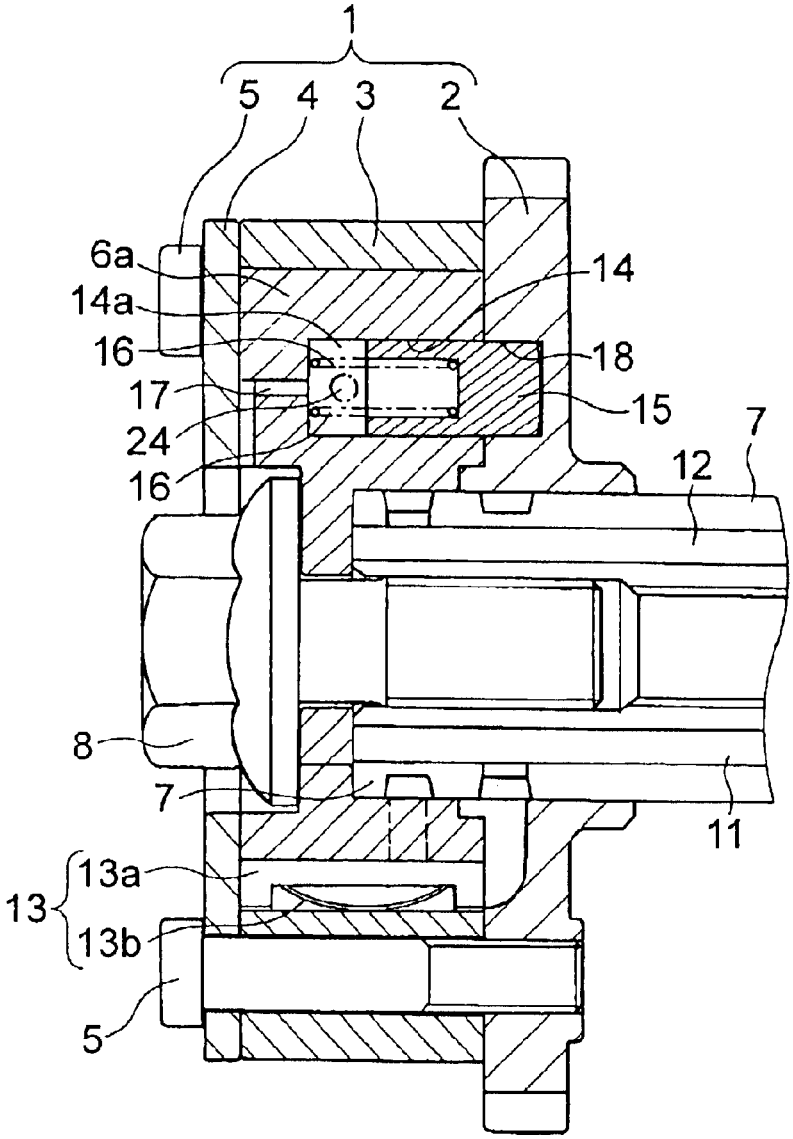
FIG. 7 is a diagram showing a vertical cross-section viewed along a line A—A shown in FIG. 6.
Figure 8:
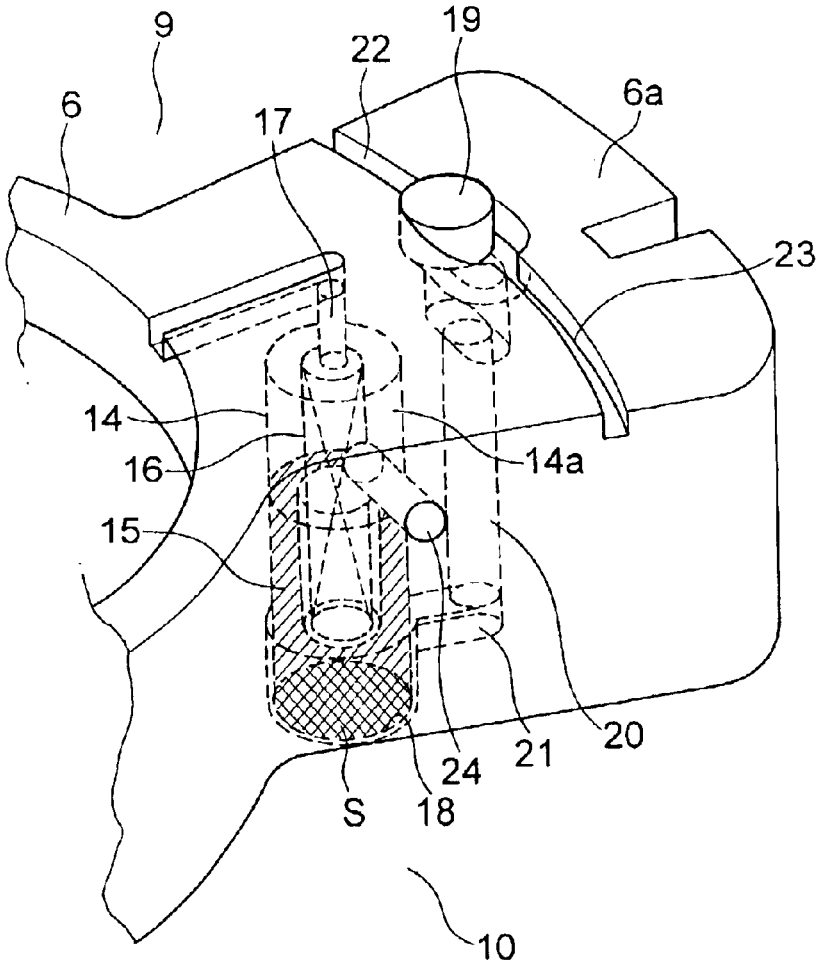
FIG. 8 is an enlarged perspective view of a main portion of a lock/lock release mechanism in the actuator shown in FIG. 6.
Figure 9A:
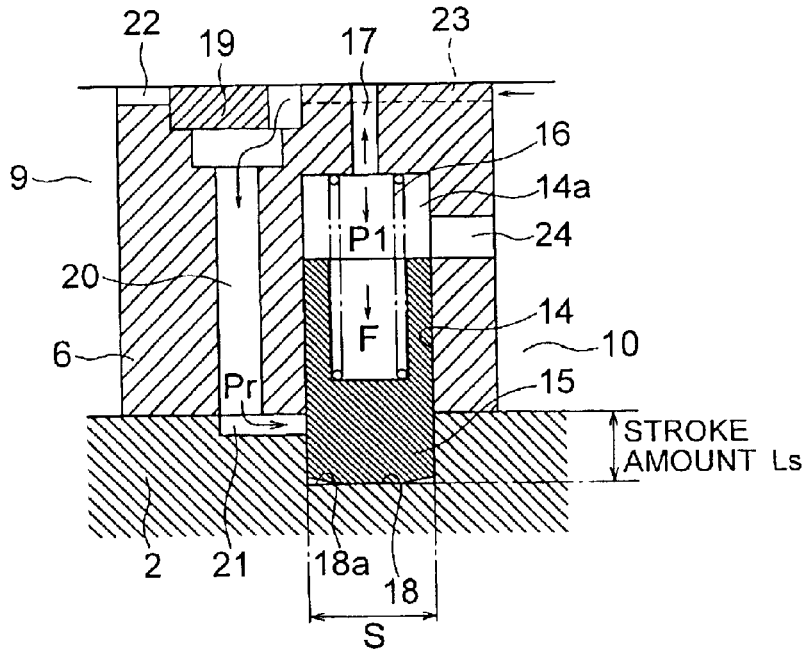
FIGS. 9A and 9B are diagrams showing a vertical cross-sectional view of the lock/lock release mechanism shown in FIG. 8.
Figure 9B:
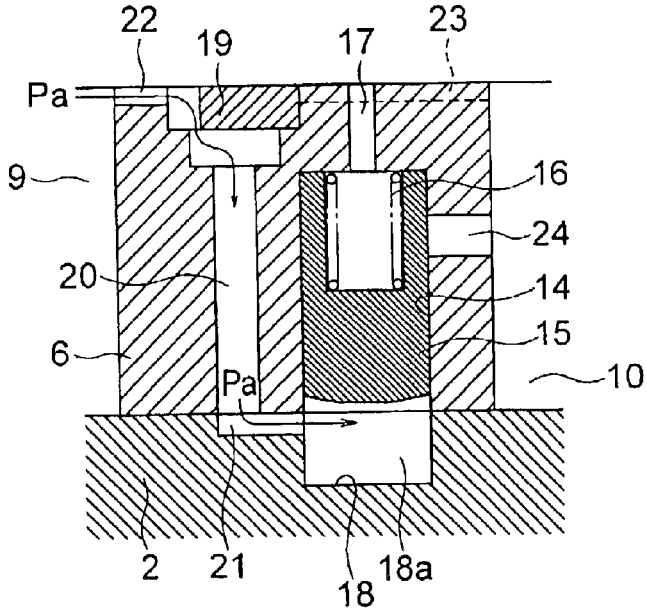

First, a construction and outline of the actuator (i.e., the valve timing adjustment device) 1113 shown in FIGS. 6 to 9B will be described. Note that, FIG. 6 is a lateral cross-sectional diagram showing the internal construction of a vane-type valve timing adjustment device. FIG. 7 is a diagram showing a vertical cross-section viewed along a line A—A shown in FIG. 6. FIG. 8 is an enlarged perspective view of a main portion of a lock mechanism/lock-release mechanism in the valve timing adjustment device shown in FIG. 6. FIGS. 9A and 9B are diagrams showing a vertical cross-section of the lock mechanism/lock-release mechanism shown in FIG. 8. In those drawing, reference numeral 1 (constituted by reference numerals 2 to 5, cf. FIG. 7) denotes a first rotating body; reference numeral 2 denotes a sprocket; reference numeral 3 denotes a case; reference numeral 3*a* denotes a shoe; reference numeral 4 (cf. FIG. 7) denotes a cover; reference numeral 5 denotes a fastening member; reference numeral 6 denotes a rotor (a second rotating body); reference numeral 6*a* denotes a vane; reference numeral 7 denotes a cam shaft; reference numeral 8 (cf. FIG. 7) denotes a fastening member; reference numeral 9 denotes an lead angle-side oil pressure chamber; reference numeral 10 denotes a delay angle-side oil pressure chamber; reference numeral 11 denotes a first oil passage (a pressure chamber supply passage); reference numeral 12 denotes a second oil passage (a pressure chamber supply passage); reference numeral 13 denotes sealing means; reference numeral 14 (cf. FIG. 7) denotes a storage hole; reference numeral 14*a* (cf. FIG. 7) denotes a back pressure portion; reference numeral 15 (cf. FIG. 7) denotes a lock pin (a lock member); reference numeral 16 (cf. FIG. 7) denotes biasing means; reference numeral 17 denotes an exhaust hole; reference numeral 18 (cf. FIG. 7) denotes an engagement hole; reference numeral 18*a* (cf. FIGS. 9A and 9B) denotes a lock-release oil pressure chamber; reference numeral 19 denotes a check valve; reference numeral 20 (cf. FIG. 8) denotes a first lock-release oil pressure supply passage; reference numeral 21 denotes a second lock-release oil pressure supply passage; reference numeral 22 denotes an lead angle-side pressure distribution passage; reference numeral 23 denotes a delay angle-side pressure distribution passage; and reference numeral 24 denotes a purge passage.

In the actuator 1113 shown in FIGS. 6 to 9B, when the engine is started, the oil pressure is supplied from an oil pump to the delay angle-side oil pressure chamber 10. As it is being provided thereto, air that is caught up (in the oil) is expelled through the purge passage 24 out from the exhaust hole 17 to outside the device. When the air is expelled, a residual oil pressure is generated by the oil provided to the back pressure portion 14*a*, increasing the release oil pressure and preventing the release of the lock. When switched to the lead angle-side oil pressure, the oil pressure resists only the biasing force of the biasing means 16, pressuring the tip of the lock pin 15 toward the release direction to release the lock.

When the internal combustion engine 1101 is started, the OCV 1114 is controlled such that the oil is supplied to the delay angle-side oil pressure chamber 10 in the actuator 1113. When the internal combustion engine 1101 is stopped, there is a possibility that the oil in the actuator 1113 and in the oil passage from the oil pump to the actuator 1113 will fall into the oil pan. In the case where such occurs, when the engine is started, the air in the oil passage, or the oil containing the air, is introduced to the delay angle-side oil pressure chamber 10. The air, or the oil which contains air, that is introduced to the delay angle-side oil pressure chamber 10, is expelled through the purge passage 24, the back pressure portion 14*a*, and the exhaust hole 17, to outside the actuator.

After the engine is started, the oil pressure from the delay angle-side pressure distribution passage 23 is introduced to the lock-release oil pressure chamber 18*a* as well, but the lock pin 15 is maintained in the closed state by means of the biasing force of the biasing means 16.

Accordingly, the lock pin 15 is inhibited from slipping out of the engagement hole 18 at the start time, so that the rotor 6 does not jiggle around and make an abnormal noise.

After the internal combustion engine 1101 is started, in a case where, for example, the driver steps on the accelerator and a command to switch to the lead angle side is given, the OCV 1114 is controlled to introduce the oil pressure to the lead angle-side oil pressure chamber 9 in the actuator 1113.

The oil in the lead angle-side oil pressure chamber 9 passes through the lead angle-side oil pressure distribution passage 22 and is introduced into the lock-release oil pressure chamber 18*a*. Since the OCV 1114 is controlled to a position to expel the oil in the lead angle-side oil pressure chamber 10, the oil in the lead angle-side oil pressure chamber 10 passes through the OCV 1114 and is expelled to the oil pan. The oil pressure resists only the biasing force of the biasing means 16, pushing the tip of the lock pin 15 toward the release direction, so that the lock pin 15 slips out from the engagement hole 18, the rotor 6 becomes able to move, and the oil pressure in the lead angle-side oil pressure chamber 9 causes the rotor to move toward the lead angle side, thus achieving the angle-advancement control.

Note that, since the processing sequence of the oil temperature estimation is the same as in Embodiment 1 (FIG. 2 and FIG. 3), description thereof is omitted.

Description will now be made regarding a lock release control means in the valve timing control system for an internal combustion engine. The lock release control executes a control in which, for example, the electrical flow increase rate to the OCV is increased little by little, so that the introduction of the oil pressure to the lead angle-side oil pressure chamber occurs slowly, to thereby cause the rotor to operate more after the lock pin slips out of the engagement hole. The initial value of the electrical current that is applied to the OCV 1114 is set more in the direction not to release the lock state (i.e., toward the delay angle side) than an electrical current value Ib, and the OCV current value Iout is increased with a given proportion (i.e., electrical flow increase rate) toward a direction to release the lock mechanism (i.e., toward the lead angle side).

Figure 12:
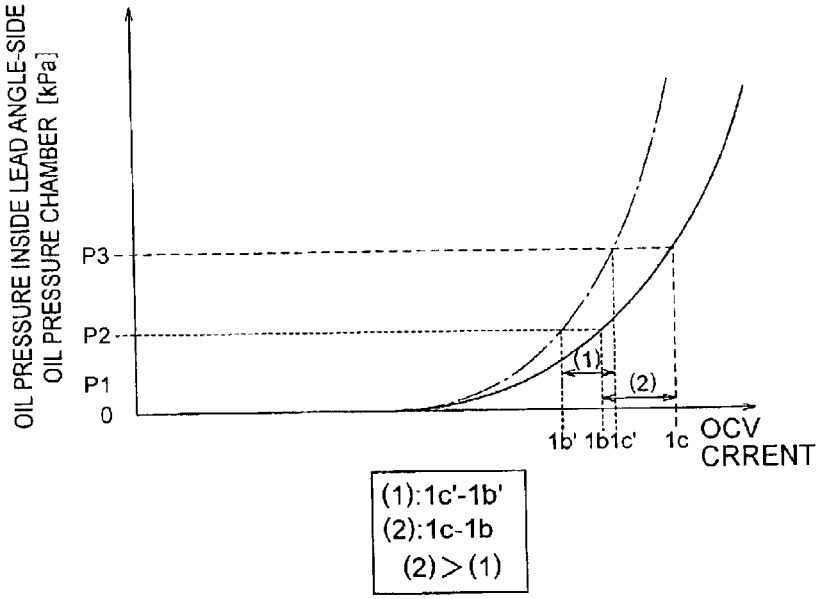
FIG. 12 is an explanatory diagram showing a relationship between the OCV current and an oil pressure supplied to an lead angle-side oil pressure chamber in a cam phase actuator, in cases with different OCV upstream oil pressures.

FIG. 12 is a diagram showing a relationship between the OCV current and the oil pressure supplied to the lead angle-side oil pressure chamber 9 inside the cam phase actuator 1113, in cases with different OCV upstream oil pressures. Since the angle that the aperture of the oil passage in the OCV 1114 is closed is determined uniquely with respect to the current applied to the OCV 1114, in cases where, for example, the OCV currents are identical, the case with the higher OCV upstream oil pressure will produce a higher oil pressure to be supplied to the cam phase actuator 1113. In other words, the relationship between the OCV current and the oil pressure supplied to the OCV downstream side is dependent upon the OCV upstream oil pressure.

Further, in the valve timing control system with the oil pump driven by the rotation of the crank shaft, the OCV upstream oil pressure is dependent upon the engine rotation speed. For example, when the rotation speed increases, the OCV upstream oil pressure rises. Further, when the oil temperature changes, the viscosity of the oil changes, and thus the discharge efficiency of the oil pump changes. For example, in a case where the oil temperature is high, the viscosity of the oil drops, and thus the discharge rate of the oil pump drops, and the OCV upstream oil pressure drops. As such, the COV current values Ib and Ic that should be applied to supply the angle advancement oil pressure chamber with an oil pressure P2 and a rotor operating oil pressure P3 which can completely release the lock pin 15, are influenced by the r.p.m. and the oil temperature of the internal combustion engine 1101. In accordance with the example shown in FIG. 12, the oil pressure that is supplied to the lead angle-side oil pressure chamber 9 in the cam phase actuator 1113 in a certain representative operating state is indicated by a solid line. Further, the OCV currents corresponding respectively to the oil pressures P2 and P3 are indicated as Ib and Ic. On the other hand, the oil pressure supplied to the lead angle-side oil pressure chamber 9 in the case where the OCV upstream oil pressure is great is indicated by an alternate long and short dash line. Similarly, the OCV currents corresponding respectively to the oil pressures P2 and P3 are indicated as Ib' and Ic'. From FIG. 12, it is understood that the electric current range capable of releasing the lock pin 15 is smaller in the case of (Ic'−Ib') (reference numeral (1)) than in the case of (Ic-Ib) (reference numeral (2)).

Therefore, in cases where the OCV currents are increased with the same current increase rate, the case with the higher OCV upstream oil pressure passes more quickly through the electrical current range capable of releasing the lock pin 15. As such, instances may occur in which sufficient time to move the lock pin 15 by a stroke amount Ls cannot be secured. In order to overcome this problem, in the case of the higher oil pressure, the current increase rate is reduced, to thereby secure sufficient time to move the lock pin 15 by the stroke amount Ls.

Figure 13:
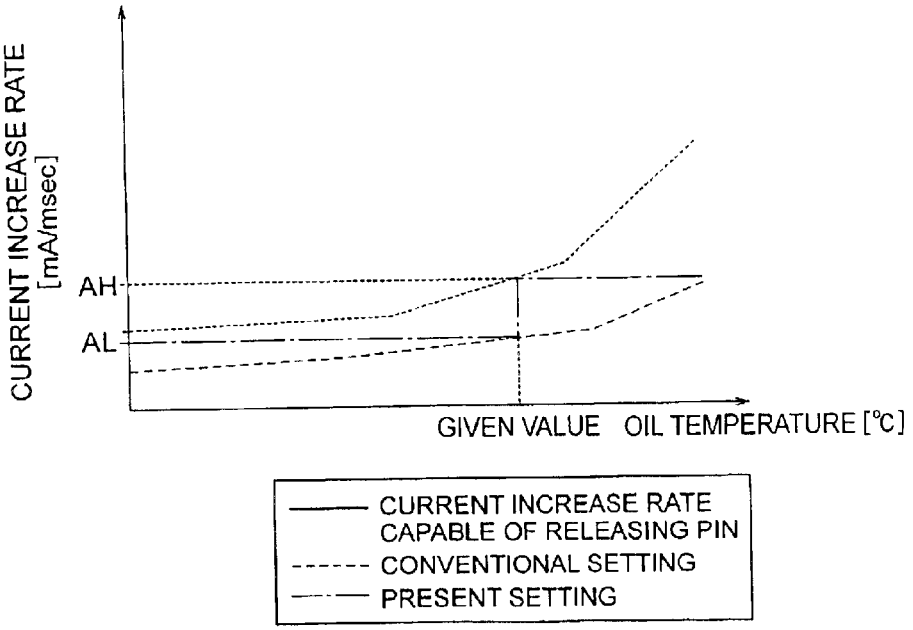
FIG. 13 is an explanatory diagram indicating the setting value of the current increase rate, with respect to the oil temperature in the internal combustion engine.

As described above, in the case where the oil temperature is low, that is to say, the oil pressure is high, the electric current range capable of releasing the lock pin is passed more quickly than in the case where the oil temperature is high, that is, the oil pressure is low. Therefore, sufficient time for removing the lock pin cannot be secured. In order to overcome this problem, in the case where the oil temperature is low, as shown in FIG. 13, the current increase rate is set as lower.

In the case where the oil temperature is estimated only from the start time water temperature used in the conventional device, to determine the control amount for the lock pin release means, the precision of the start time oil temperature estimation is poor, as mentioned in the explanation of Embodiment 1. Therefore, in order to definitely release the lock pin, the current increase rate setting (i.e., the dotted line) has to be set to less than the oil temperature/current increase rate characteristic shown in FIG. 13 (i.e., the solid line). Thus, even after the actual lock pin release, unnecessary pin-pulling operations are carried out until the removal of the pin is detected (i.e., until the actual valve timing reaches the given value), creating a delay in following up the real target valve timing required by the operating state, which causes the drivability of the internal combustion engine to deteriorate.

However, in accordance with the oil temperature estimation means of the present embodiment, the precision of the oil temperature estimation at the start time is increased so that the current increase rate can be set in response to the oil temperature (for example, the value of the current increase rate during the warming up state can be set higher than that during the cooling down state). Thus, the pin removal operation can be shortened, the real target valve timing required by the operating state can be followed up better, and the drivability of the internal combustion engine can be improved.

Figure 11:
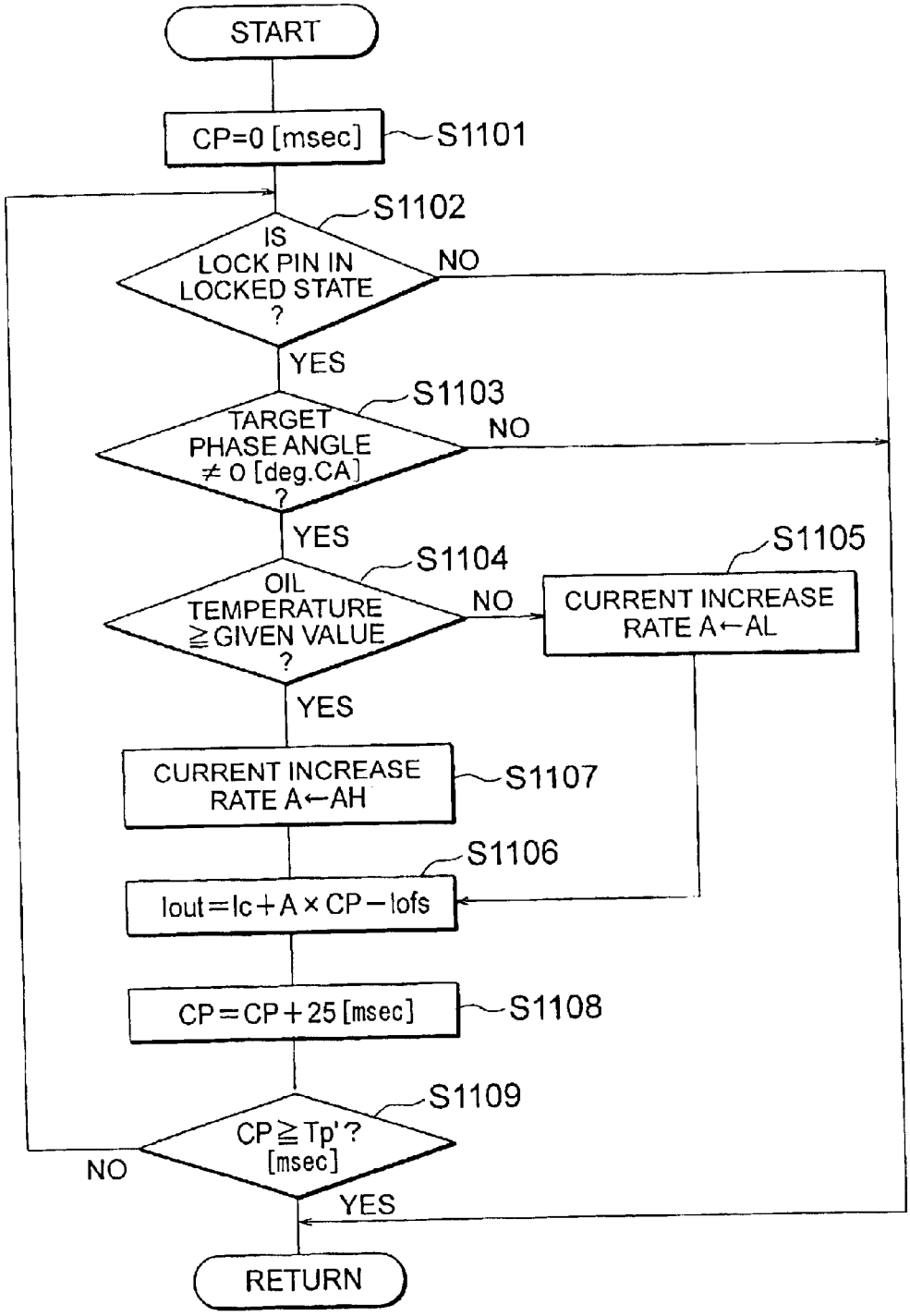
FIG. 11 is a timing flow chart regarding an OCV electrical current, in a case where a lock pin is released.

FIG. 11 is a flow chart illustrating content of control performed for the OCV current Iout at the time when the lock pin 15 is released, before the rotor 6 rotates/operates toward the lead angle side. At step S1101, a pin release time counter CP is reset to 0. At step S1102, it is determined whether or not the lock pin 15 is in the locked state, and in the case of Yes, then, at step S1103, it is determined that the target phase angle (i.e., the target valve timing) θt is not at its most retarded angle position. In the case where No is determined at step S1102, the processing for releasing the lock pin ends, and the process moves to the normal phase feedback control. At step S1103, it is determined whether the target phase angle θt is not at its most retarded angle position (that is, it is not at 0 [deg. CA]), and in the case of Yes, then, at step S1104, it is judged whether the oil temperature estimated by the oil temperature estimation processing is above the given value (for example, 90° C.). If it is greater than the given value, then, at step S1105, a high-oil-temperature current-increase-rate AH is selected as a current increase rate A from the map shown in FIG. 13 and stored in the ECU 1117. Then, at step S1106, the OCV current Iout is set to Iout=Ic+A×CP−Iofs. Here, Ic represents the holding current value; A represents the current increase rate for the OCV current (e.g., 0.1 [mA/msec]); and Iofs represents a given amount (e.g., 200 [mA]) for setting the initial value of the OCV current Iout on the retardation angle side.

At step S1105, in the case where the oil temperature is less than the given value, a low-oil-temperature current-increase-rate AL is selected as the current increase rate A from the map that is shown in FIG. 13 and stored in the ECU 1117, and then, at step S1106, substituted for the current increase rate A for the formula for the OCV current value Iout, and the OCV current value Iout is obtained.

In the case of No at step S1103, the lock pin release processing ends, and the process moves to the normal phase feedback control. At step S1106, the pin release time counter CP is increased by the amount of the processing cycle (e.g., 25 [msec]). At step S1107, it is determined whether or not the pin release time counter CP has exceeded a time duration Tp' (e.g., 1500 [msec]). In the case of Yes at step S1107, it is understood that the release of the lock pin 15 is completed, and the process moves to the normal phase feedback control. In a case of No at step S1107, the releasing of the lock pin 15 should be continued, so the process returns to step S1102. The flow chart in FIG. 11 is carried out once per given time duration (25 ms).

This time, the determination of the current increase rate A according to the estimated oil temperature, is performed in the flow chart shown in FIG. 11. However, it is also possible to determine in advance the current increase rate A in accordance with the estimated oil temperature, and use the determined current increase rate A in the flow chart to obtain the OCV current value.

Figure 15:
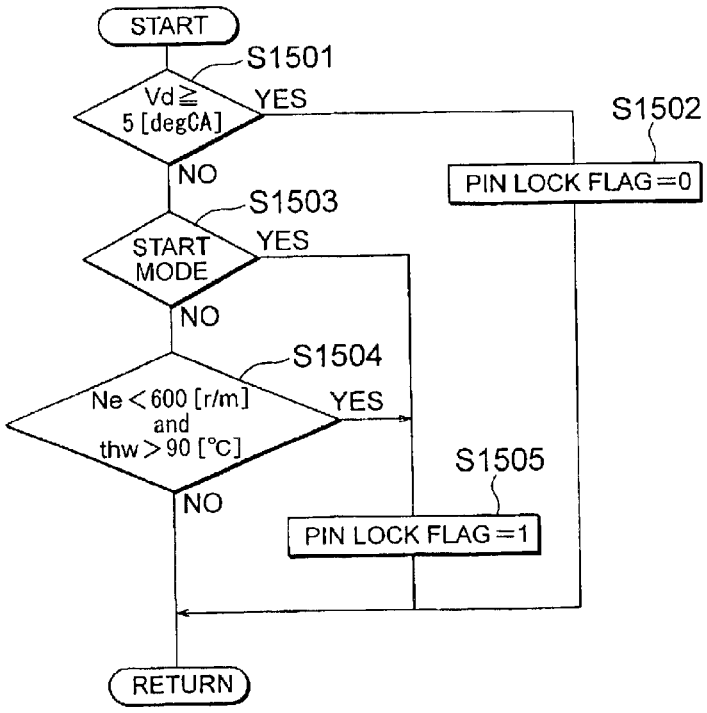
FIG. 15 is a flow chart illustrating content of controls performed for determining that the lock pin is in a locked state.

The flow chart shown in FIG. 15 is processing for determining whether or not the lock pin 15 is engaged in the engagement hole 18. At step S1501 it is determined whether or not the detected phase angle (i.e., the actual valve timing) (Vd) is greater than a given amount (e.g., 5 [deg CA]). If it is greater than the given amount (5 [deg CA]), the rotor 6 is operating on the lead angle side. Therefore, since the lock pin 15 is out of the engagement hole 18, it is determined that the pin is released, and the pin lock flag is set to zero at step S1502. In the case of NO at step S1501, it is then determined at step S1503 whether or not the engine is in a starting mode. In the case of Yes, the oil pressure stops being generated by the oil pump when the internal combustion engine 1101 is stopped, and the lock pin 15 is engaged in the engagement hole 18. Therefore, it is determined that the pin is locked, and at step S1505 1 is set for the pin lock flag.

In the case of NO at step S1503, in a case where the rotation speed (Ne) is less than a given value (e.g., 600 [r/m]) and the water temperature (thw) is greater than a given value (e.g., 90[° C.]), then, at step S1505, the pin lock flag is set to 1. In the case of NO at step S1504, the processing ends as it is. Therefore, in the case where at step S1503 the engine is not in the start mode, and, at step S1504, the rotation speed (Ne) is greater than the given value, and the water temperature (thw) is less than the given value, the pin lock flag value that is previously set remains. Therefore, if the start mode or the rotation speed (Ne) becomes less than the given value, and the water temperature (thw) becomes greater than the given value even once, the pin lock flag remains as it is set. Since the lock pin 15 is not removed either unless the oil is introduced into the lead angle-side oil pressure chamber 9, the state of the pin lock flag and the actual operation of the lock pin 15 correspond to each other, and thus a problem does not occur.

Figure 10:
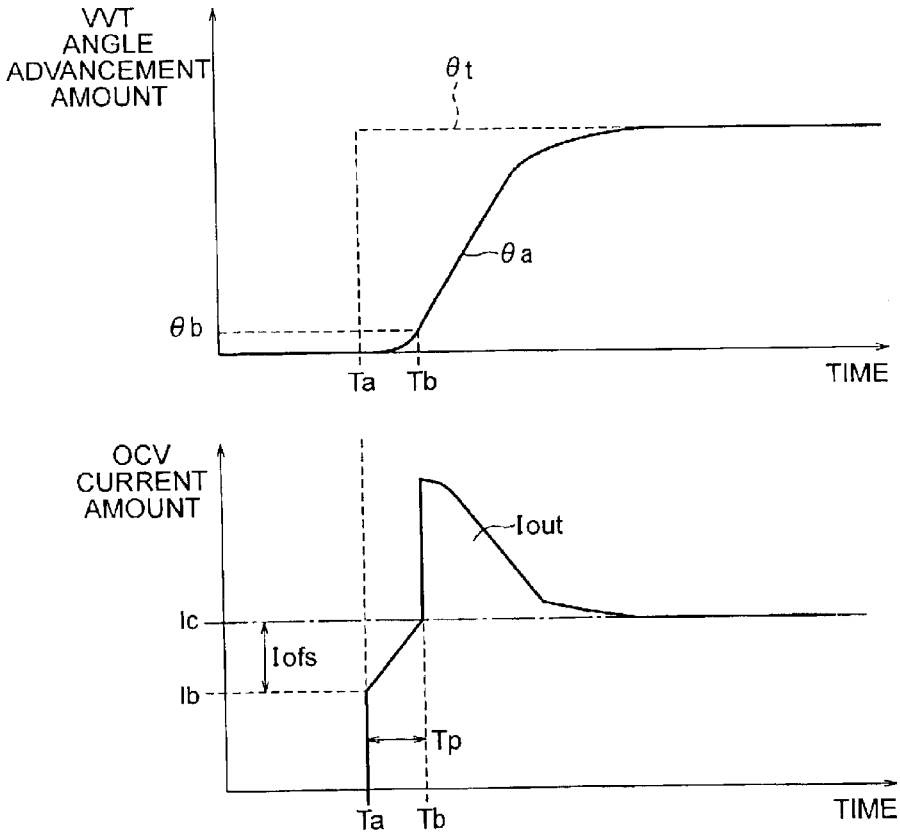
FIG. 10 is an explanatory diagram indicating a setting value for a current increase rate, with respect to oil temperature in the internal combustion engine.

FIG. 10 is a time chart illustrating a relationship among the target phase angle θt, the detected phase angle θa, and the OCV current Iout, in a case where the lock pin 15 release method shown in the flowchart in FIG. 11 is performed immediately before executing the general phase feedback control (PID control).

The lock pin release processing is started simultaneously with the outputting of the target phase angle θt, at a point in time Ta. The OCV current Iout increases gradually, starting from a value Ib that is smaller than the holding current value Ic by an amount equal to the given value Iofs.

A point in time Tb, is a point when the detected phase angle θa becomes a given angle θb (e.g., 5° CA), and at this point the pin release processing ends, and the process moves to the phase feedback control (PID control). During a duration Tp (=Tb−Ta), the current increases at the current increase rate A described above.

FIG. 13 is a diagram illustrating a value set as the current increase rate, with respect to the oil temperature in the internal combustion engine 1101. As described above, when the oil pressure is high, it is necessary to set the current increase rate low. Therefore, the current increase rate is set to decrease when the oil pressure rises, which is to say when the discharge rate of the oil pump is great and the oil temperature is low.

The current increase rate A shown in FIG. 13 is stored in the ECU 1117, the oil temperature estimation means estimates the OCV upstream oil temperature, and the OCV upstream oil pressure is estimated using the oil temperature and is applied at step S1104 shown in FIG. 11 upon calculation of the OCV current Iout.

In the case described above, since the oil temperature sensor and the oil pressure sensor can be eliminated, the system can be simplified and cost reduction can be achieved.

Note that, in accordance with the above-mentioned embodiment, the estimation of the internal combustion engine 1101 being in the warming up state was performed with a combination of the engine r.p.m., the cooling water temperature and the replenishment efficiency (the intake air amount). However, it is also possible to use one of the respective parameters to estimate the warming up state. If a plurality of parameters other than those mentioned above (e.g., a throttle aperture angle) are combined, it is possible to estimate the warming up state of the internal combustion engine with good precision.

As described above, in the state where the lock pin 15 is engaged, when the target phase angle θt changes away from the angle position where the lock pin 15 is engaged, the initial value for the OCV current value Iout to be applied is set toward the direction so that the locked state is not released in comparison with the holding current value 1c, the current increase rate is determined according to the oil temperature estimated by the oil temperature estimation means, and the OCV current value is changed toward the direction so to release the lock state. This enables the lock pin 15 to be released without fail in a short period of time.

Therefore, the lock pin 15 can be removed without fail in a short period of time, the actual valve timing can be controlled appropriately with respect to the target valve timing, and the deterioration of the drivability, the gas mileage and the exhaust gas of the internal combustion engine can be prevented.

As described above, in accordance with the valve timing control system for an internal combustion engine in accordance with the present embodiment, the control amount that is determined by the lock release control means, is switched based on the oil temperature of the operating oil in the valve timing control mechanism, which is estimated by the oil temperature estimation means according to the previous operating state and the current operating state of the internal combustion engine. Therefore, without providing a new oil pressure sensor or the like, it is possible to estimate the oil temperature of the operating oil in the valve timing control mechanism according to the previous operating state of the internal combustion engine, and the current operating state with high precision, to release the lock mechanism without fail in a short period of time, and appropriately control the actual valve timing with respect to the target valve timing, to thereby obtain an effect preventing the deterioration of the drivability, the gas mileage and the exhaust gas of the internal combustion engine.

What is claimed is:

1. A valve timing control system for an internal combustion engine, comprising:

operating state detecting means for detecting an operating state of an internal combustion engine;

actual valve timing detection means for detecting valve timing of at least one of an intake valve and an exhaust valve;

target valve timing setting means for setting a target valve timing for said valve timing, based on a detection result from said operating state detecting means;

an actuator for changing the valve timing of at least one of said intake valve and said exhaust valve;

oil pressure adjusting means for supplying oil to said actuator to drive said actuator and performing adjustment of the oil pressure thereof;

actual valve timing control means for controlling the actuator by controlling said oil pressure adjusting means, in order to make said valve timing follow up said target valve timing; and oil temperature estimation means for estimating the temperature of said oil supplied to said actuator by said oil pressure adjusting means, based on a state of said internal combustion engine during its previous operation time, and based on its current operation state, wherein said actual valve timing control means switches a control amount for controlling said oil pressure adjusting means, based on the oil temperature estimated by said oil temperature estimation means.

2. A valve timing control system for an internal combustion engine, comprising:

operating state detecting means for detecting an operating state of an internal combustion engine;

actual valve timing detection means for detecting valve timing of at least one of an intake valve and an exhaust valve;

target valve timing setting means for setting a target valve timing for said valve timing, based on a detection result from said operating state detecting means;

an actuator for changing the valve timing of at least one of said intake valve and said exhaust valve;

oil pressure adjusting means for supplying oil to said actuator to drive said actuator and performing adjustment of the oil pressure thereof;

actual valve timing control means for controlling said actuator by controlling said oil pressure adjusting means, in order to make said valve timing follow up said target valve timing;

lock means for engaging with said actuator at a given relative angle, and having the engagement be released due to oil being supplied to one of an lead angle side or a delay angle side of the actuator;

lock release control means for controlling said oil pressure adjusting means so that, when the lock means is in a lock position and said valve timing is going to be changed, a release operation for the lock means is performed before the valve timing changes; and oil temperature estimation means for estimating the temperature of the oil that said oil pressure adjusting means supplies to the actuator, based on a state of said internal combustion engine during its previous operation time, and based on its current operation state, wherein the lock release control means switches a control amount for controlling said oil pressure adjusting means, based on the oil temperature estimated by said oil temperature estimation means.

3. A valve timing control system for an internal combustion engine according to claim 1, wherein said oil temperature estimation means estimates that the oil temperature is above a given value, in a case where a warming-up state of the internal combustion engine continued for a given duration of time or longer during a previous operating time, and a start time water temperature in the current operation was above a given value.

4. A valve timing control system for an internal combustion engine according to claim 3, wherein said oil temperature estimation means estimates whether or not the internal combustion engine is in the warming-up state, based on a temperature of cooling water for cooling the internal combustion engine, and obtains a cumulative value of a duration that the internal combustion engine is determined as being in the warming-up state.

5. A valve timing control system for an internal combustion engine according to claim 3, wherein said oil temperature estimation means estimates whether or not the internal combustion engine is in the warming-up state, based on the r.p.m. of the internal combustion engine, and obtains a cumulative value of a duration that the internal combustion engine is determined as being in the warming up state.

6. A valve timing control system for an internal combustion engine according to claim 3, wherein said oil temperature estimation means estimates whether or not the internal combustion engine is in the warming-up state based on a filling efficiency (an intake air amount), and obtains a cumulative value of a duration that the internal combustion engine is determined as being in the warming up state.

7. A valve timing control system for an internal combustion engine according to claim 3, wherein said oil temperature estimation means estimates whether or not the internal combustion engine is in the warming up state, based on a throttle opening degree, and obtains a cumulative value of a duration that the internal combustion engine is determined as being in the warming up state.

8. A valve timing control system for an internal combustion engine according to claim 2, wherein said oil temperature estimation means estimates that the oil temperature is above a given value, in a case where a warming-up state of the internal combustion engine continued for a given duration of time or longer during a previous operating time, and a start time water temperature in the current operation was above a given value.

9. A valve timing control system for an internal combustion engine according to claim 8, wherein said oil temperature estimation means estimates whether or not the internal combustion engine is in the warming-up state, based on a temperature of cooling water for cooling the internal combustion engine, and obtains a cumulative value of a duration that the internal combustion engine is determined as being in the warming-up state.

10. A valve timing control system for an internal combustion engine according to claim 8, wherein said oil temperature estimation means estimates whether or not the internal combustion engine is in the warming-up state, based on the r.p.m. of the internal combustion engine, and obtains a cumulative value of a duration that the internal combustion engine is determined as being in the warming up state.

11. A valve timing control system for an internal combustion engine according to claim 8, wherein said oil temperature estimation means estimates whether or not the internal combustion engine is in the warming-up state based on a filling efficiency (an intake air amount), and obtains a cumulative value of a duration that the internal combustion engine is determined as being in the warming up state.

12. A valve timing control system for an internal combustion engine according to claim 8, wherein said oil temperature estimation means estimates whether or not the internal combustion engine is in the warming up state, based on a throttle opening degree, and obtains a cumulative value of a duration that the internal combustion engine is determined as being in the warming up state.

* * * * *